United States Patent [19]

Beyl

[11] 4,177,584

[45] Dec. 11, 1979

[54] SKI BOOT AND BINDING ASSEMBLY

[76] Inventor: Jean J. A. Beyl, 10, Bd Victor-Hugo, 58000 Nevers, France

[21] Appl. No.: 889,001

[22] Filed: Mar. 22, 1978

[30] Foreign Application Priority Data

Mar. 28, 1977 [FR] France ..... 77 09159

[51] Int. Cl.[2] ..... A43B 5/04; B62B 0/00

[52] U.S. Cl. ..... 36/117; 280/613

[58] Field of Search ..... 36/117, 118, 119, 120, 36/121; 280/611, 613, 614, 618

[56] References Cited

U.S. PATENT DOCUMENTS 1,868,386 7/1932 Gresrig ..... 36/117

3,779,570 12/1973 Betschart ..... 280/613

FOREIGN PATENT DOCUMENTS 1678289 12/1971 Fed. Rep. of Germany ..... 36/117

2401729 7/1975 Fed. Rep. of Germany ..... 280/613

*Primary Examiner*—Patrick D. Lawson

*Attorney, Agent, or Firm*—Bierman & Bierman

[57] ABSTRACT

In this ski-boot and ski-binding assembly the boot comprises lateral protruding anchoring members disposed at a same distance from, and on either side of, the middle point of the boot, and the ski carries on its top a flat case having a central "O" mark coincident with the corresponding "O" mark of the ski; on either side of the flat case pivotally mounted hook means disposed at equal distances from the central "O" mark are adapted releasably to retain the boot by engaging the anchoring members of the boot. These anchoring members and hook means may be disposed by pairs, and the anchoring means may consist of the opposite ends of transverse metal rods embedded in the material constituting the sole of the ski-boot. Possibly, a single flat metal member may be used to provide the anchoring members, or the rods may be interconnected by a perforated metal plate.

7 Claims, 7 Drawing Figures

2
3b
3b
13
13
5

1
10
12
4
M
N
O
3
9
11
8
S
a
L1
L2
b

SKI BOOT AND BINDING ASSEMBLY

BACKGROUND OF THE INVENTION

1. Field of the Invention

The present invention relates in general to ski boots and ski bindings, and has specific reference to an improved combination between a ski-boot and a ski binding specially designed for receiving this boot.

2. Description of the Prior Art

Nowadays, most ski bindings comprise on the one hand a toe-end device capable of clamping the toe end of the ski boot and on the other hand a heel hold-down device. Consequently, the distance between these two devices and their respective positions on the ski are subordinate to the length or size of the ski boot.

Under these conditions, before fitting the ski bindings to a pair of skis, the operator entrusted with this work firstly places the skier's boots on the skis, in the desired position. In fact, this step is necessary if the operator is to know the exact locations of the toe and heel ends of each boot and consequently the positions in which the corresponding bindings will have to be secured to the skis.

To facilitate this operation, the skis are provided in general with a mark showing the position contemplated for the central point of the ski boot, a corresponding mark being carried by the boot itself. However, even so the positions of the toe and heel devices will differ according to the length of the ski boots.

Besides, problems arise in case the user changes his pair of ski boots. In fact, in this case the toe and heel bindings must be shifted to different positions, and this is attended in most instances by the drilling of other holes in the skis, thus impairing the resistance of the skis themselves.

To avoid this inconvenience, skis let out on hire are equipped in general with bindings comprising means for the longitudinal adjustment or setting thereof. Usually, these means are associated with the heel hold-down device, the toe-end device remaining stationary. However, this solution is not satisfactory since the position of the toe end of the ski boot remains fixed, so that certain skiers will have their boots secured too much forwards, and others too far at the rear.

In contrast with the conventional ski bindings mentioned in the foregoing, certain known devices comprise retaining means capable of co-acting with an intermediate point of the ski-boot length and also with the heel end thereof. But also in this case, this solution cannot eliminate the difficulties arising from variations in length of the ski-boots as a function of their size. There is also known, through the French Pat. No. 74 16349, a device comprising lateral anchoring means disposed on either side of the ski boot and consisting of jaws pivotally mounted on a case secured to the ski. These jaws are adapted to co-act with catches or like projections resiliently urged outwards from the boot sole, and the dimensions of these members can easily lend themselves to a standardization for the complete range of ski-boot sizes. Thus, it is unnecessary to readjust the bindings as a function of the boot size.

However, the anchoring elements of this device are located at a fixed distance on either side of the axis of the skier's tibia, this also applying to the jaws provided for retaining the anchoring elements.

When it is desired to properly position a ski-boot of a size smaller than a given boot assumed to be positioned correctly, by means of this device, i.e. by causing the central point of the sole to register with the reference mark carried by the ski, the case must be shifted in relation to the ski, in this specific example in the forward direction. If the case is not shifted, the middle point of the sole will lie behind the ski reference mark, in order to permit the proper positioning of the ski-boot anchoring elements with respect to the retaining jaws, so that the skier will not be properly positioned on the ski, that is, somewhat at the rear of the correct position. Conversely, for a ski-boot of a size higher than that of the boot assumed to be properly positioned, the skier would be positioned forwards of the correct position.

Thus, this known device requires an adjustment in relation to the ski when changing from one boot size to another, while eliminating by adjustment within the binding.

SUMMARY OF THE INVENTION

It is therefore the essential object of the present invention to avoid the inconveniences disclosed in the foregoing by providing an assembly comprising a special ski-boot and a ski-binding specially designed for receiving this ski-boot, the component elements of this assembly being free of the inconvenience resulting from the difference in length of the ski-boots.

With this object in view, the present invention provides a ski-boot and ski-binding assembly in which the boot comprises lateral anchoring members capable of co-acting with retaining members forming an integral part of the binding and mounted on the sides of a flat casing adapted to be fitted to the ski and to constitute a support for the ski-boot, this assembly being characterized in that, in the longitudinal direction, the distance between each anchoring member and the middle point of the boot is invariable and predetermined, independently of the boot size, whereas each ski-binding retaining member is likewise located at an invariable distance in relation to a reference mark carried by the case, this reference mark being adapted to be brought in proper registration with an assembling mark carried by the ski for indicating the location assigned to the middle point of the boot thereon.

The retaining members of the anchoring device may thus be secured to the ski without taking into account the exact length of the boot selected by the skier. In fact, it is only necessary to take due consideration of the reference mark carried by the ski for showing the position assigned to the middle point of a ski-boot, irrespective of the exact length thereof.

The ski-boots according to this invention, which shall subsequently be secured to the ski, will compulsorily be located in the desired position when the lateral anchoring members provided on the boots are anchored to the retaining member carried by the ski.

The flat case may be secured to the ski and provided with a reference mark adapted to be brought in proper registration with the reference mark carried by the ski, to show the position assigned to the middle point of a ski-boot, irrespective of the exact length of the boot.

Thus, it is only necessary to secure this case to the ski by causing these two marks to coincide, and the retaining members carried by the case will automatically occupy the proper positions in relation to the position contemplated for the middle point of the boot.

In a modified form of embodiment of the present assembly, the ski binding comprises two pairs of retaining members disposed on either side of the middle point of the boot, the retaining members of each pair being located at predetermined distances in relation to the corresponding center line. Of course, in this case, the corresponding boots shall also comprise two pairs of anchoring members adapted to co-act with said retaining members and said pairs of anchoring members shall be located, with respect to the middle point of the boot, at distances corresponding to those contemplated between the retaining members of the binding and the location contemplated for the middle point of the boot.

However, in a simplified form of embodiment the ski binding may if desired comprise only one pair of retaining members, the corresponding ski-boots being provided in this case with a single pair of lateral anchoring members. But, of course, in this case these members are also located at an invariable distance with respect to the middle point of the boot, irrespective of the length of the various ski-boots according to the present invention that may be used therewith.

However, other features and advantages of the present invention will appear as the following description proceeds with reference to the accompanying drawing given by way of illustration, not of limitation.

DESCRIPTION OF THE PREFERRED EMBODIMENTS

Figure 1:
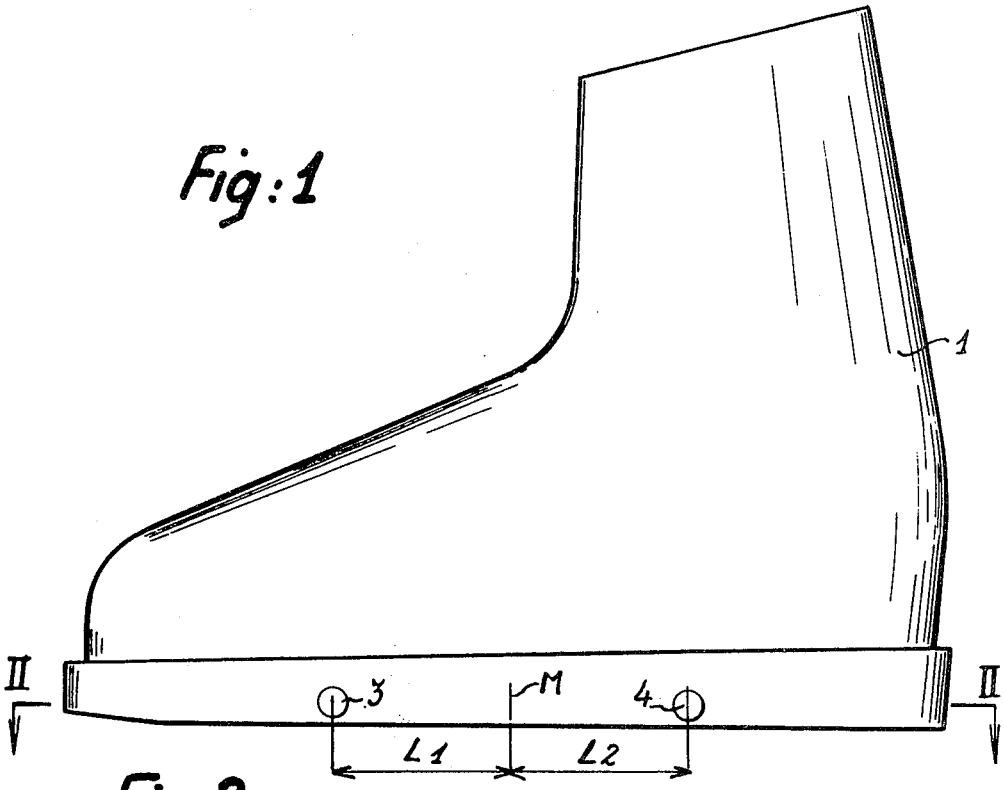
FIG. 1 is a side elevational view showing diagrammatically a ski-boot incorporated in the assembly according to the invention.

Reference will now be made firstly to FIGS. 1 to 4 of the drawing, showing a first form of embodiment of the assembly according to the present invention. In this arrangement, the ski-boot 1 comprises on either side of its sole 2 a pair of anchoring projections or catches 3, 4. These two pairs of members are disposed on either side of the median transverse plane M of the ski-boot but at fixed distance from this plane for all sizes of the same type of boots.

Thus, irrespective of the length of each one of the boots contemplated in this form of embodiment, the two lateral anchoring members 4 of a same pair are located at an invariable distance $L_2$ from the median transverse plane M. As to the two projecting lateral members 3 of the other pair, they are also located at an invariable distance $L_1$ in relation to said median transverse plane M. These two distances $L_2$ and $L_1$ may be equal to or different from each other. Of course, the difference E between the two pairs of anchoring menbers 3 and 4 is also invariable since it corresponds to the sum $L_1+L_2$.

The two adjacent lateral anchoring members 3 and 4 of a same pair may advantageously consist of the ends of a pair of transverse rods 5 and 6 embedded in the material of the same sole 2 and of such length that these ends protrude from the side edges of the sole to constitute said projections 3 and 4. When the sole 2 is manufactured by moulding a suitable plastics material, according to the now general trend, the two rods 5 and 6 are disposed beforehand in the corresponding mould cavity. Of course, if desired, flat-sectioned metal blades also disposed transversely to the boot axis may be substituted for the rods 5 and 6.

Figure 2:
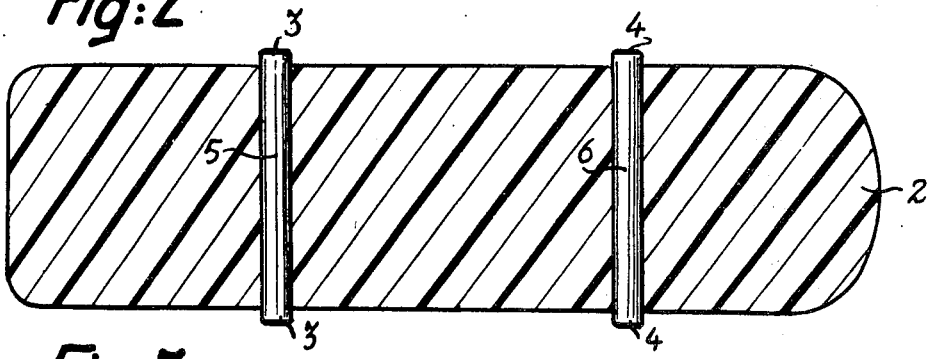
FIG. 2 is a horizontal section taken along the line II—II of FIG. 1.
Figure 3:
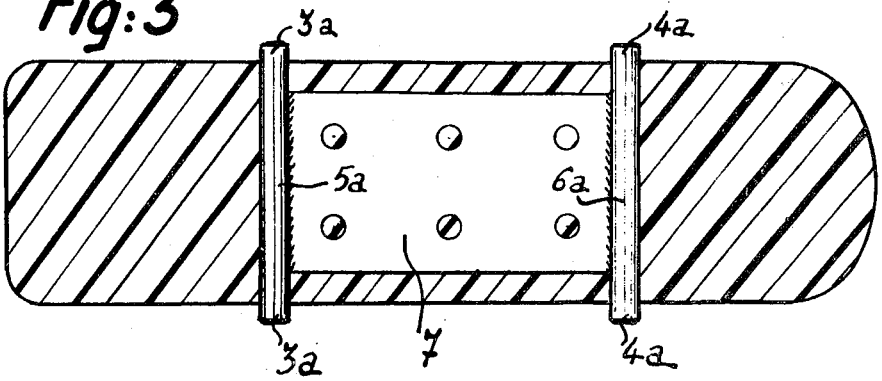
FIG. 3 is a view similar to FIG. 2 but showing a modified embodiment.

As illustrated in FIG. 3, a preferably perforated metal plate 7 may be embedded in the corresponding moulded sole 2, this plate 7 having secured at its ends a pair of rods 5*a* and 6*a* also protruding laterally from the sole to constitute the lateral projections 3*a* and 4*a* similar to the members 3 and 4 of the preceding form of embodiment shown in FIGS. 1 and 2.

In all cases, the projecting members of the two pairs are at a fixed distance with respect to the median transverse plane M of the sole or boot.

Figures 4, 5:
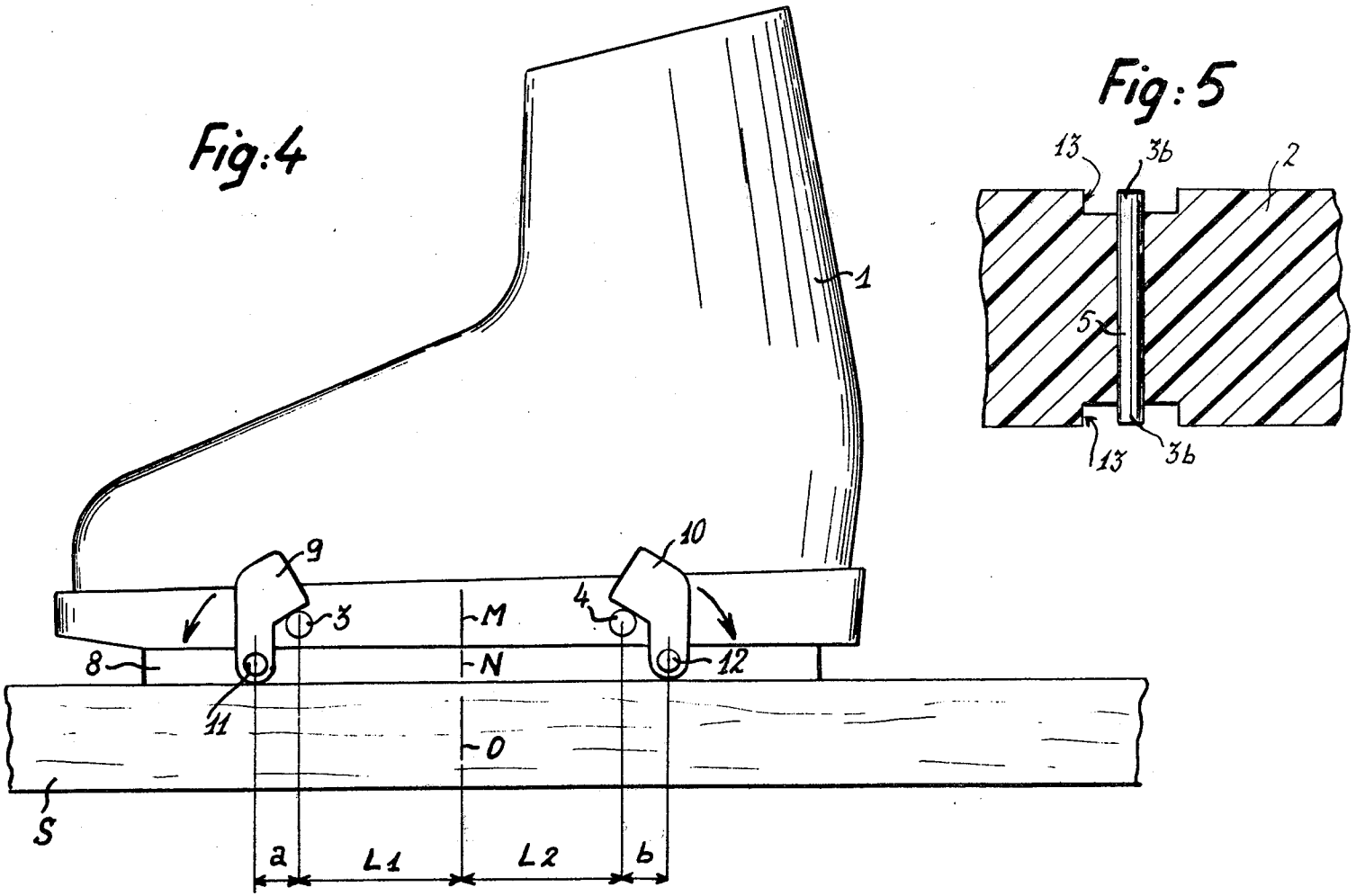
FIG. 4 is a side elevational view showing the same ski-boot after the fitting thereon on the ski-binding specially designed for receiving this boot, this binding being also an integral part of the assembly according to the present invention.
FIG. 5 is a fragmentary section taken along a plane similar to that of line II—II, but showing another form of embodiment.

The binding means contemplated for co-acting with the above described ski-boot comprise in turn two pairs of retaining members capable of receiving the lateral anchoring members 3 and 4, respectively. As illustrated in FIG. 4, this device comprises a relatively flat case 8 adapted to receive the sole of the ski-boot 1 on its top surface. On either lateral side, this case 8 is provided with retractable hooks 9 and 10 constituting the retaining members proper adapted to engage and lock the lateral anchoring members 3 and 4 of the corresponding ski-boot.

In the example illustrated, these hooks 9, 10 are pivotally mounted by means of horizontal pins 11 and 12 to the case 8, so that they can release the boot by pivoting forwardly and rearwardly, respectively, as seen in FIG. 4. This pivotal mounting is intended to facilitate the proper positioning of the ski-boot by engaging the lateral anchoring members 3 and 4 thereof under the hooks 9 and 10. However, this pivotal movement is also intended for releasing the boot in case abnormal efforts were exerted on the skier's foot and leg, and such as to constitute a danger for the skier. For this purpose, these hooks 9, 10 are urged to their normal positions shown in FIG. 4 by resilient locking mechanisms (not shown). These mechanisms are so designed that they afford or possibly control the pivotal movements of hooks 9 and 10 to their retracted or release position when abnormal efforts are exerted on the foot or leg, in order to release the ski-boot to avoid any risk of accident.

The distance between the two pairs of pivoting hooks 9 and 10 is such that these hooks can efficiently engage and retain the two pairs of lateral anchoring members 3 and 4 rigid with the boot. In actual practice, this distance is greater than the distance E existing between the two pairs of anchoring members 3 and 4, this difference corresponding to the sum of the differences between centres a and b which exist between the centre of the anchoring members 3 and 4 and the centre of the fulcrum pins 11 and 12 when the hooks 9 and 10 are in the operative position illustrated in FIG. 4.

But in fact the position of hooks 9 and 10 is determined in relation to a reference mark N formed on the case 8 of the binding device, this mark N being necessarily coincident with the "O" mark usually printed or engraved on the ski for indicating the position assigned to the median transverse line M of the ski-boot to be placed on the ski. In fact, the pair of front hooks 9 are fulcrumed on the case 8 at a position such that the distance between the axis of pivot pins 11 and the reference mark N be equal to $L_1+a$ (a corresponding to the distance between the centres or axes of anchoring members 3 and pivot pins 11, when the hooks 9 are in their operative position). The rear hooks 10 are located on the case 8 at a location such that their axis 12 lie at a distance $L_2+b$ with respect to the same reference mark N. Also in this case, b denotes the gap existing between the centres of anchoring members 4 and pivot pins 12 when the hooks 10 are in their operative position. If we disregard the distances between centres a and b (which depend on the specific construction of hooks 9 and 10), it may be said that these hooks are disposed in relation to reference mark N at distances determined essentially by the above-mentioned distances $L_1$ and $L_2$.

When securing the case 8 to the ski S, it is only necessary to dispose the mark N of this case in alignment with the "O" mark carried by the ski for indicating the position assigned to the median transverse line M of the ski-boot. Thus, irrespective of the length of the ski-boot subsequently fitted to the ski, its median transverse line or middle point will automatically register with the desired location, without having to modify the position of the binding members. Besides, this binding device may be secured beforehand to the skis, even before putting them on sale, irrespective of the skiers' boot size, and the skier's boot will in all case be secured exactly at the proper location.

On the other hand, when a skier is confronted with the problem of changing his ski-boots, he can do that without interfering with the retaining members already carried by the ski, since the binding device according to this invention can receive any type of ski-boots, provided that the new pair of boots is consistent with the present invention, i.e. boots of the type described hereinabove and designated by the reference numeral 1 in the accompanying drawing.

Of course, this assembly is particularly advantageous in the case of skis to be let out for hire. In fact, when changing from one user to another, with the present assembly it is no more necessary to change the position of the ski-boot retaining means or binding normally secured to the ski.

Instead of projecting from the lateral sides of the sole 2, the anchoring members 3 and 4 of the boot may be disposed within cavities 13 formed on the two sides of the sole (see FIG. 5). In this case, the projecting members may, as in the preceding case, consist of the projecting end portions **3*b* of a transverse rod 5 embedded in the thickness of the boot sole, said end portions projecting only into the lateral cavities 13 but not beyond the contour of said sole 2**.

This arrangement is advantageous in that the presence of any element protruding from the lateral sides of the boot sole are safely avoided. Another advantageous feature of this arrangement is that in the operative possition the retaining hooks are also located within the cavities 13, and therefore protected from possible shocks or contact with other elements or bodies.

Figure 6:
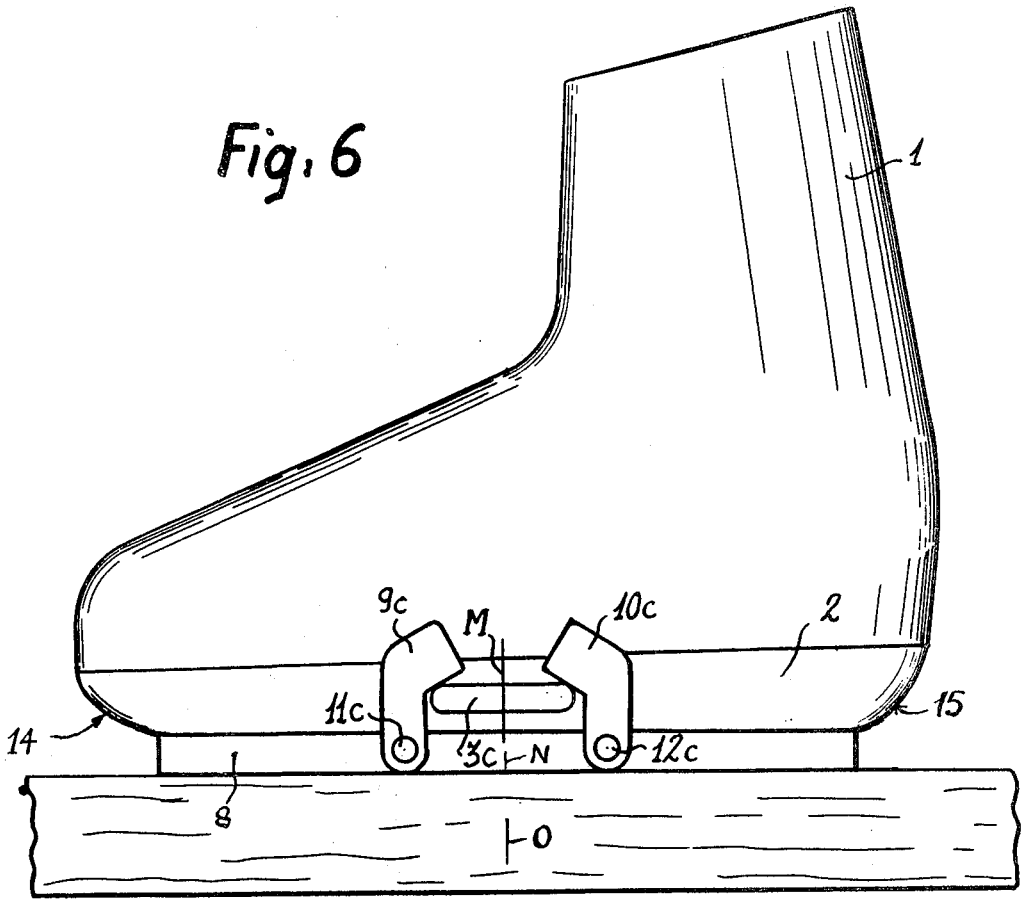
FIG. 6 is a side elevational view of a modified form of embodiment of a ski-boot according to this invention.
Figure 7:
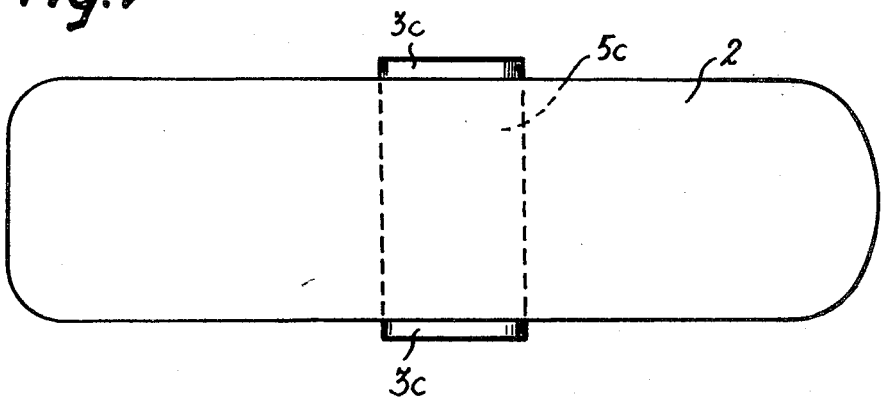
FIG. 7 is a plane view, after under surface of the ski-boot illustrated on FIG. 6.

Instead of two groups of lateral anchoring members, the ski-boot according to this invention may comprise only one such group, as illustrated in FIGS. 6 and 7. In this case, these anchoring members, as in the preceding examples, should be located at an invariable distance from the transverse median plane of the boot.

More particularly, in the example illustrated in FIGS. 6 and 7, the two anchoring members thus contemplated are located in the middle of the boot sole and consist of the projecting ends **3*c* of a metal member of elongated cross-sectional configuration which is embedded in the material constituting the sole 2**, the centre line of this metal member being coincident with the transverse median line M of the boot proper.

The binding to be associated with this boot comprises on either side a pair of pivotally mounted hooks **9*c*, 10*c* adapted to clamp the opposite ends of the protruding portion of the anchoring member 3*c*. The position of said hooks 9*c* and 10*c*** is determined accordingly.

Of course, the ski-boot and binding assembly according to this invention may lend itself to many changes and modifications without departing from the basic principles of the invention. Thus, instead of being pivotally mounted about horizontal axes for moving forwardly and rearwardly, the retaining members of the ski-binding may be mounted for pivotal movement away from the ski. If desired, these retaining members may also be mounted for longitudinal sliding movement. However, any other type of movement, or a combination of several different movements, may be contemplated, for obtaining the desired retraction of the boot retaining members.

As already pointed out in the foregoing, the essential advantage deriving from the ski-boot and binding assembly according to this invention lies in the fact that it makes it possible to eliminate the constraints characterizing conventional ski-bindings incorporating in most instances a device for releasably retaining the front or toe end of the ski-boot and another retaining device for holding down the heel end of the ski-boot. However, another advantageous feature characterizing the present invention, which derives from the preceding one set forth hereinabove, is that it is also possible to give a round configuration to the toe end 14 of the ski-boot and also to the heel end 15 thereof, this shape facilitating the use of the ski-boot for walking.

What is claimed as new is:

1. A ski-boot and ski-binding assembly for use with skis provided with a mounting mark, comprising in combination, transversely extending anchoring means carried by said ski boot, said means having a pair of projecting engaging surfaces on either side of the boot, longitudinally spaced on either side of the substantially longitudinal center of the boot, a casing mounted on said ski intermediate the boot and ski, said casing bearing a reference mark adapted to be aligned with a mounting mark on said ski, and a pair of retaining members on each side of said casing fixedly longitudinally spaced on each side of said reference mark and adapted releasably to engage the longitudinally spaced projecting surfaces of said anchoring means, whereby the center of said ski boot is aligned with the mounting mark on said ski.

2. A ski-boot and ski-binding assembly according to claim 1, in which said anchoring means comprises two pairs of laterally extending anchoring members disposed on either side of said center and in which said retaining members are adapted releasably to engage the respective projecting ends of said anchoring members.

3. A ski-boot and ski-binding assembly according to claim 1, in which said anchoring means comprises a single pair of anchoring members whose opposed edges are located at a fixed distance with respect to said center, said retaining members being adapted releasably to engage the projecting edges of said anchoring members.

4. A ski-boot and ski-binding assembly according to claim 1, in which said anchoring means comprises a pair of metal rods disposed transversely and imbedded in the boot sole, the ends of said rods projecting from the lateral sides of said sole for engagement with said retaining members.

5. A ski-boot and ski-binding assembly according to claim 4, in combination with a plate interconnecting said metal rods.

6. A ski-boot and ski-binding assembly according to claim 1, in which the ski boot is provided with inwardly disposed cavities about the projecting surfaces of said anchoring means, and said projecting surfaces are contained within said cavities and remain within the lateral sides of the boot.

7. A ski-boot and ski-binding assembly according to claim 1, in which said retaining members comprise hook means pivotally mounted on said casing, said hook means being so shaped with respect to the projecting surfaces which they engage that they release the boot when abnormal efforts are exerted upon the skiers leg as by tilting forwardly or rearwardly.

* * * * *